US008374518B2

(12) United States Patent
Watanabe

(10) Patent No.: US 8,374,518 B2
(45) Date of Patent: Feb. 12, 2013

(54) IMAGE FORMING APPARATUS AND IMAGE FORMING METHOD

(75) Inventor: Yoshihisa Watanabe, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 245 days.

(21) Appl. No.: 12/790,116

(22) Filed: May 28, 2010

(65) Prior Publication Data

US 2010/0303485 A1 Dec. 2, 2010

(30) Foreign Application Priority Data

May 29, 2009 (JP) ..... 2009-129776

(51) Int. Cl.

| | |
|---|---|
| ***G03G 15/00*** | (2006.01) |
| ***G03G 15/16*** | (2006.01) |
| ***G03G 15/01*** | (2006.01) |
| ***G03G 15/20*** | (2006.01) |

(52) U.S. Cl. ..... 399/43; 399/44; 399/66; 399/299; 399/314

(58) Field of Classification Search ..... 399/43, 399/66

See application file for complete search history.

(56) References Cited

U.S. PATENT DOCUMENTS

| | | | | |
|---|---|---|---|---|
| 7,272,331 | B2 * | 9/2007 | Kobayashi et al. | 399/44 |
| 7,343,109 | B2 * | 3/2008 | Nishimura | 399/43 |
| 7,639,976 | B2 * | 12/2009 | Yoshida | 399/302 |
| 7,720,399 | B2 * | 5/2010 | Takahashi | 399/44 |
| 7,978,991 | B2 * | 7/2011 | Tomiie | 399/44 |
| 2003/0175041 | A1 * | 9/2003 | Taguchi et al. | 399/66 |
| 2004/0218938 | A1 * | 11/2004 | Ono et al. | 399/45 |
| 2007/0110462 | A1 * | 5/2007 | Hayashi et al. | 399/45 |
| 2007/0253736 | A1 * | 11/2007 | Ehara et al. | 399/167 |
| 2009/0136270 | A1 * | 5/2009 | Yamada | 399/308 |
| 2010/0196030 | A1 * | 8/2010 | Okubo et al. | 399/53 |
| 2010/0196033 | A1 * | 8/2010 | Shirafuji | 399/66 |
| 2010/0247130 | A1 * | 9/2010 | Ishida | 399/69 |

FOREIGN PATENT DOCUMENTS

| | | |
|---|---|---|
| JP | 2007-24999 | 2/2007 |
| JP | 2008-256922 | 10/2008 |

* cited by examiner

*Primary Examiner* — David Gray
*Assistant Examiner* — Tyler Hardman
(74) *Attorney, Agent, or Firm* — Oblon, Spivak, McClelland, Maier & Neustadt, L.L.P.

(57) ABSTRACT

An image forming apparatus includes a receiver to receive image information from an external device, a movable intermediate transfer member, a plurality of latent image bearing members on which a latent image is formed based on the image information, a plurality of developing devices, each of which disposed in proximity to the latent image baring member, to develop the latent image on the latent image bearing member with toner to form a toner image thereon, a transfer bias application mechanism to apply a transfer bias to the intermediate transfer member and halt temporarily and periodically application of the transfer bias in a continuous output mode in which a plurality of images are continuously formed on different recording media sheets based on the image information of the plurality of images received continuously by the receiver, and a secondary transfer member to transfer the superimposed toner image onto a recording medium.

20 Claims, 4 Drawing Sheets

IMAGE FORMING APPARATUS AND IMAGE FORMING METHOD

CROSS-REFERENCE TO RELATED APPLICATIONS

This patent application is based on and claims priority pursuant to 35 U.S.C. §119 from Japanese Patent Application No. 2009-129776, filed on May 29, 2009 in the Japan Patent Office, which is hereby incorporated herein by reference in its entirety.

BACKGROUND OF THE INVENTION

1. Field of the Invention

Exemplary aspects of the present invention generally relate to an image forming apparatus, and more particularly, to a tandem-type image forming apparatus that forms toner images on a plurality of latent image bearing members, transfers the toner images onto an intermediate transfer member on one another, and transfers the superimposed toner image onto a recording medium.

2. Description of the Background Art

Conventionally, there is known a tandem-type image forming apparatus equipped with an endlessly rotatable intermediate transfer belt that is wound around a plurality of rollers, process cartridges for colors yellow, magenta, cyan, and black arranged in a direction of movement of the intermediate transfer belt, and so forth.

Each of the process cartridges includes, for example, a photoreceptor serving as a latent image bearing member and a developing device. In such a process cartridge, the surface of the photoreceptor is illuminated with light so that an electrostatic latent image is formed on its surface. Then, the developing device develops the electrostatic latent image with a respective color of toner, thereby forming a visible image, known as a toner image.

The toner images of yellow, magenta, cyan, and black formed on the respective photoreceptor are superimposed on the intermediate transfer belt. Accordingly, a multi-color toner image is formed on the intermediate transfer belt. Lastly, the multi-color toner image is secondarily transferred onto a recording medium.

In such a tandem-type image forming apparatus, a problem, known as reverse transfer, may occur in all the process cartridges except for the process cartridge disposed substantially at the initial part, or upstream end, of the transfer process. For example, if the toner images of yellow, magenta, cyan, and black are sequentially superimposed, in that order, on the intermediate transfer belt, the process cartridge for yellow corresponds to the process cartridge disposed at the upstream end of the transfer process.

Except for the process cartridge for yellow, in the rest of the process cartridges, that is, the process cartridges for magenta, cyan, and black, the toner images transferred on the intermediate transfer belt upstream therefrom may be undesirably transferred back onto the photoreceptors again. This phenomenon is the so-called reverse transfer phenomenon (hereinafter simply "reverse transfer"). Such reverse transfer results in an abnormal multi-color image.

Various print experiments performed by the present inventor using a test machine similar to the known tandem-type image forming apparatuses showed that reverse transfer tended to occur when images were continuously formed on a relatively large number of recording media sheets when the image forming apparatus was operating in a continuous output mode.

Specifically, it was found that an electric potential of the intermediate transfer belt of the test machine increased gradually during the continuous output mode in which 500 sheets were output over a relatively long period of time, such that, when the potential of the intermediate transfer belt reached a certain level, electric discharge occurred in a space between the intermediate transfer belt and a device such as a process cartridge casing disposed opposite the belt, thereby degrading adhesion between the toner and the intermediate transfer belt.

As a result, the toner was reversely transferred from the intermediate transfer belt to the photoreceptors in the process cartridges disposed further downstream in the transfer process. Thereafter, the potential of the intermediate transfer belt continued rising until application of the transfer bias to the intermediate transfer belt stopped.

The present inventor also discovered that if application of the transfer bias relative to the intermediate transfer belt was temporarily halted, for example, for one minute, the belt potential returned to a normal level even after rising a certain amount due to the continuous output.

SUMMARY OF THE INVENTION

In view of the foregoing, in one illustrative embodiment of the present invention, an image forming apparatus includes a receiver, a movable intermediate transfer member, a plurality of latent image bearing members, a plurality of developing devices, a transfer bias application mechanism, and a secondary transfer member. The receiver receives image information from an external device. The plurality of latent image bearing members is disposed substantially in proximity to the intermediate transfer member and arranged along a direction of movement of the intermediate transfer member. A latent image is formed on each of the latent image bearing member based on the image information. The plurality of developing devices is disposed in proximity to the latent image baring member and develops the latent image on the latent image bearing member with toner to form a toner image thereon. The transfer bias application mechanism applies a transfer bias to the intermediate transfer member and transfers the toner images onto the intermediate transfer member on one another. The secondary transfer member transfers the superimposed toner image onto a recording medium. The transfer bias application mechanism halts temporarily and periodically application of the transfer bias in a continuous output mode in which a plurality of images are continuously formed on different recording media sheets based on the image information of the plurality of images received continuously by the receiver.

In another illustrative embodiment of the present invention, a method for continuously forming images on a plurality of recording media sheets includes receiving image information from an external device, forming a latent image on each of a plurality of latent image bearing members based on the image information, developing the latent image on each of the plurality of the latent image bearing members with toner to form toner images thereon, applying a transfer bias to an intermediate transfer member to transfer the toner images onto the intermediate transfer member on one another, transferring the superimposed toner image onto a recording medium, and halting temporarily and periodically application of the transfer bias in a continuous output mode in which a plurality of images are continuously formed on different recording media sheets based on the image information of the plurality of images received continuously by the receiving.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
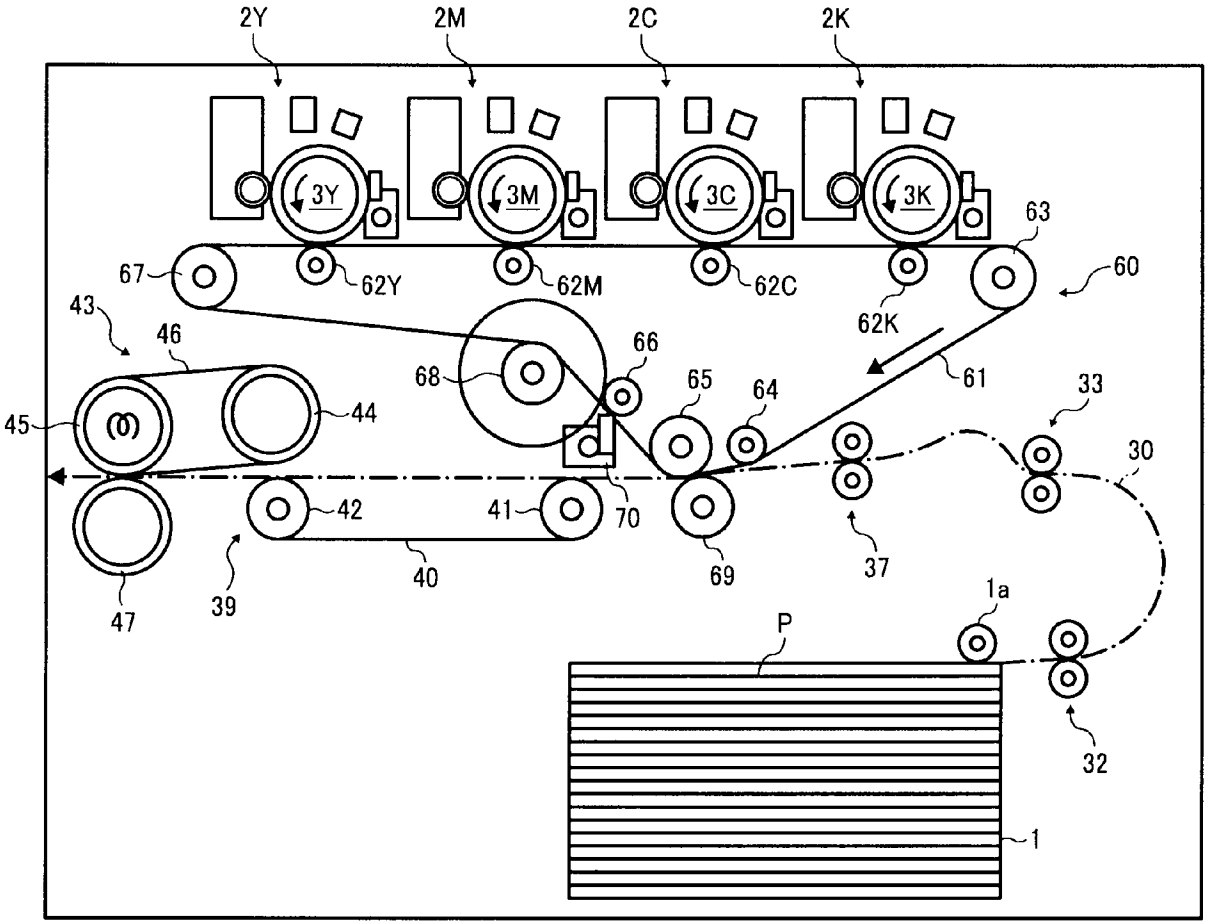
FIG. 1 is a schematic diagram illustrating a printer as an example of an image forming apparatus according to an illustrative embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity of drawings and descriptions, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, a printer as one example of an image forming apparatus according to an illustrative embodiment of the present invention is described.

Referring now to FIG. 1, there is provided a schematic diagram illustrating the image forming apparatus that produces an image through electrophotography according to the illustrative embodiment of the present invention. The image forming apparatus includes a sheet feed cassette 1, process units 2Y, 2M, 2C, and 2K, a transfer unit 60, an intermediate transfer belt 61, and so forth. The process units 2Y, 2M, 2C, and 2K are arranged in tandem in a direction of movement of the intermediate transfer belt 61.

It is to be noted that reference characters Y, M, C, and K denote colors yellow, magenta, cyan, and black, respectively.

The sheet feed cassette 1 includes a sheet feed roller 1*a* that picks up and sends a recording medium P stored in the sheet feed cassette 1 to a sheet feed path 30. The recording medium sent to the sheet feed path 30 arrives at a pair of separation rollers 32 that separates the recording medium P from the rest of the recording media sheets. The recording medium P is conveyed by a pair of conveyance rollers 33 to a pair of registration rollers 37.

It is to be noted that the process units 2Y, 2M, 2C, and 2K all have the same configuration as all the others, differing only in the color of toner employed. Thus, a description is provided of the process unit 2Y as an representative example of the process units.

Figure 2:
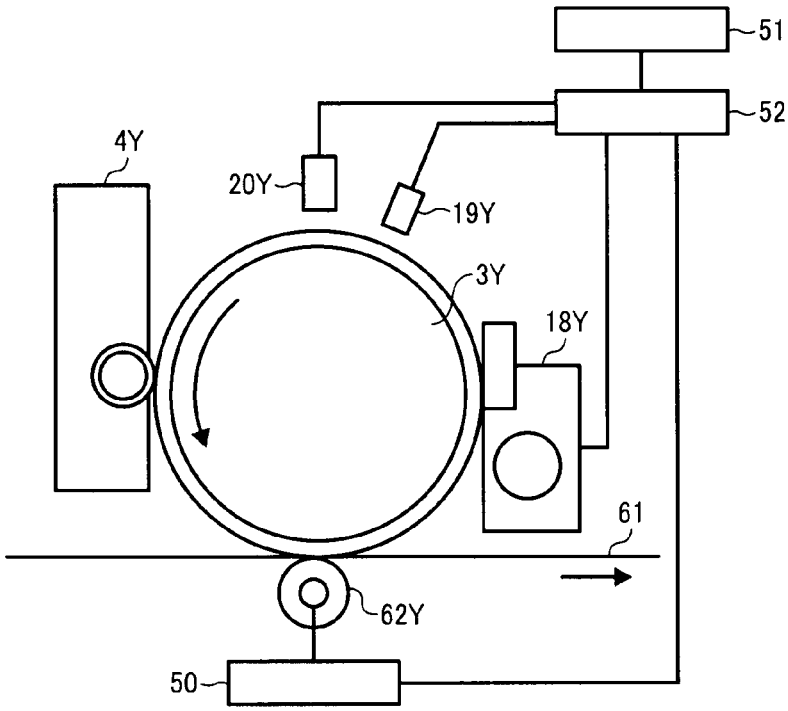
FIG. 2 is an enlarged schematic diagram illustrating a process unit for yellow as a representative example of process cartridges employed in the image forming apparatus of FIG. 1 according to an illustrative embodiment of the present invention.

As illustrated in FIG. 2, the process unit 2Y includes a photoreceptor 3Y serving as a latent image bearing member, a developing device 4Y, a cleaning device 18Y, a charging device 19Y, an optical writing unit 20Y, a discharge lamp, not illustrated, and so forth.

The photoreceptor 3Y is rotated by a driving device, not shown, in a counterclockwise direction. The charging device 19Y charges uniformly the surface of the photoreceptor 3Y to a negative polarity that is opposite the charging polarity of toner.

The optical writing unit 20Y includes an LED array or the like and generates light for writing based on a signal from an optical writing circuit, not illustrated. The light scans over the negatively charged surface of the photoreceptor 3Y, thereby forming an electrostatic latent image of yellow on the photoreceptor 3Y.

The electrostatic latent image is developed with toner by the developing device 4Y, thereby forming a yellow toner image. As the developing device 4Y, either a developing device that utilizes a two-component developer consisting of a magnetic carrier and a non-magnetic toner or a developing device that unitizes a single component developer including no magnetic carrier can be used.

According to the illustrative embodiment, the optical writing unit 20Y is installed in the respective process unit. Alternatively, however, a laser-beam optical writing unit that is constituted as an independent member independent from the process unit and illuminates the photoreceptor can be employed.

The yellow toner image formed on the photoreceptor 3Y is primarily transferred onto the intermediate transfer belt 61. After the primary transfer process, residual toner that has not been primarily transferred onto the intermediate transfer belt 61 is stuck to the surface of the photoreceptor 3Y.

The residual toner is removed from the surface of the photoreceptor 3Y by the cleaning device 18Y. After cleaning, electric charge on the surface of the photoreceptor 3Y is removed by a discharging lamp, not illustrated. After removal of charge, the charging device 19Y charges uniformly the photoreceptor 3Y again in preparation for the subsequent image forming operation.

Referring back to FIG. 1, in the process units 2M, 2C, and 2K, similar to the process unit 2Y, the toner images of magenta, cyan, and black are formed on the photoreceptors 3M, 3C, and 3K, respectively.

Substantially below the four process units 2Y, 2M, 2C, and 2K, the transfer unit 60 is disposed. In the transfer unit 60, the intermediate transfer belt 61 that is wound around and stretched between a plurality of rollers is rotated endlessly in a clockwise direction by a drive roller 63 while contacting the photoreceptors 3Y, 3M, 3C, and 3K. Between the photoreceptors 3Y, 3M, 3C, and 3K, and the intermediate transfer belt 61, primary transfer nips for yellow, magenta, cyan, and black are formed, respectively.

Primary transfer rollers 62Y, 62M, 62C, and 62K are disposed in the belt loop of the intermediate transfer belt 61. The primary transfer rollers 62Y, 62M, 62C, and 62K press the intermediate transfer belt 61 against the photoreceptors 3Y, 3M, 3C, and 3K.

A primary transfer bias is applied to the primary transfer rollers 62Y, 62M, 62C, and 62K by a primary transfer power source 50. The primary transfer rollers 62Y, 62M, 62C, and 62K, and the primary transfer power source 50 constitute a transfer bias application mechanism, not illustrated. Accordingly, a primary transfer electric field is formed in the primary transfer nips. The primary transfer electric field causes the toner images on the photoreceptors 3Y, 3M, 3C, and 3K to electrostatically move to the intermediate transfer belt 61.

As the intermediate transfer belt 61 endlessly moves and passes the primary transfer nips, the toner images are sequentially and primarily transferred onto the outer surface of the intermediate transfer belt 61 on one another in the primary transfer nips. Accordingly, a four-color composite toner image, hereinafter referred to as a four-color toner image, is formed on the outer surface of the intermediate transfer belt 61.

Substantially below the intermediate transfer belt 61, a secondary transfer roller 69 is disposed. An opposing roller 65 is disposed in the belt loop of the intermediate transfer belt 61 opposite the secondary transfer roller 69. The secondary transfer roller 69 contacts the opposing roller 65 through the intermediate transfer belt 61, thereby defining a secondary transfer nip.

A secondary transfer bias is applied by a secondary transfer power source, not illustrated, into either the opposing roller 65 in the belt loop or the secondary transfer roller 69 outside the belt loop. The other roller is electrically grounded. Accordingly, a secondary transfer electric field is formed in the secondary transfer nip.

The pair of registration rollers 37 is disposed at the right side of the secondary transfer nip in FIG. 1. The recording medium is sandwiched between the registration rollers 37. The recording medium is sent from the registration rollers 37 to the secondary transfer nip in appropriate timing such that the recording medium is aligned with the four-color toner image on the intermediate transfer belt 61.

In the secondary transfer nip, the four-color toner image on the intermediate transfer belt 61 is secondarily transferred onto the recording medium due to the secondary transfer electric field and the nip pressure, thereby forming a full-color image on the recording medium.

Figure 3:
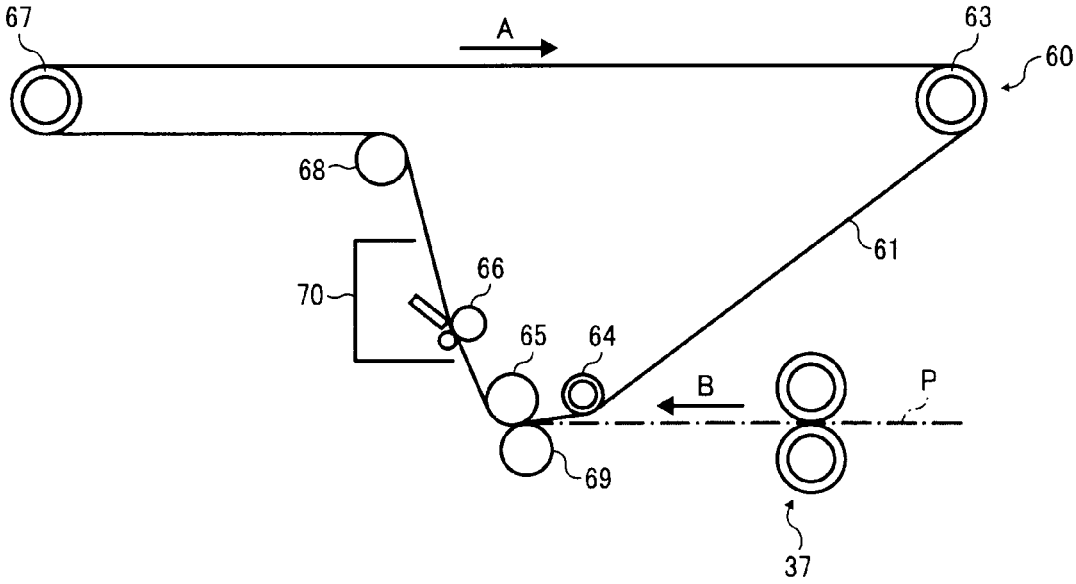
FIG. 3 is an enlarged schematic diagram illustrating a transfer unit employed in the image forming apparatus according to an illustrative embodiment of the present invention.

Referring now to FIG. 3, there is provided an enlarged schematic diagram illustrating the transfer unit 60 according to the illustrative embodiment of the present invention.

As illustrated in FIG. 3, the intermediate transfer belt 61 is wound around and stretched between the drive roller 63, a guide roller 64, the opposing roller 65, a cleaning back-up roller 66, a tension roller 67 and roller 68. The tension roller 67 exerts a certain tension against the intermediate transfer belt 61 using a weight application mechanism, not illustrated, so as to generate a frictional transport force between the drive roller 63 and the intermediate transfer belt 61.

The intermediate transfer belt 61 is stretched horizontally between the drive roller 63 and the tension roller 67. The four process units 2Y, 2M, 2C, and 2K are arranged facing the intermediate transfer belt 61 horizontally along the stretched portion of the intermediate transfer belt 61.

The guide roller 64 supports the intermediate transfer belt 61 in the vicinity of the start of the secondary transfer nip between the secondary transfer roller 69 and the opposing roller 65. The guide roller 64 is disposed outside a straight line connected from the periphery of the drive roller 63 to the periphery of the opposing roller 65, thereby enabling the intermediate transfer belt 61 to approach the start of the secondary transfer nip.

In the sheet transport path 30, the pair of sheet feed rollers 33 conveys the recording medium to the pair of the registration rollers 37. The leading edge of the recording medium contacts a nip portion defined by the registration rollers 37, thereby aligning the recording medium properly.

Subsequently, as the pair of the registration rollers 37 rotates, the recording medium is sandwiched in the nip thereof. However, immediately after the recording medium is sandwiched by the registration rollers 37, rotation of registration rollers 37 stops. Transport of the recording medium is temporarily halted. Transport of the recording medium resumes in appropriate timing such that the recording medium is aligned with the toner image on the intermediate transfer belt 61.

Residual toner that has not been transferred onto the recording medium in the secondary transfer nip remains on the outer surface of the intermediate transfer belt 61 that passed through the secondary transfer nip. The residual toner is cleaned by a cleaning device 70 that is in contact with the intermediate transfer belt 61.

As illustrated in FIG. 1, the recording medium passed through the secondary transfer nip separates from the intermediate transfer belt 61 and is transported to a conveyance belt unit 39. The conveyance belt unit 39 includes an endless conveyance belt 40, a drive roller 41, and a driven roller 42. In the conveyance belt unit 39, the conveyance belt 40 is wound around and stretched between the drive roller 41 and the driven roller 42. As the drive roller 41 rotates, the conveyance belt 40 is moved endlessly in the counterclockwise direction.

Subsequently, the recording medium is transported from the secondary transfer nip to the conveyance belt 40. As the conveyance belt 40 endlessly moves, the recording medium on the conveyance belt 40 is transported to a fixing unit 43.

As illustrated in FIG. 1, the fixing unit 43 includes a drive roller 44, a heating roller 45, a fixing belt 46, and a pressure roller 47. The heating roller 45 includes a heat source inside thereof. The fixing belt 46 is rotated endlessly in the clockwise direction in accordance with rotation of the drive roller 44. The pressure roller 47 disposed below the fixing belt 46 contacts the surface of the fixing belt 46, thereby defining a fixing nip. The recording medium that is sent to the fixing unit 43 is pressed and heated in the fixing nip so that the full-color toner image is fixed onto the recording medium.

As illustrated in FIG. 2, the image forming apparatus according to the illustrative embodiment includes a receiver 51 that receives image information transmitted from external devices such as a scanner, a personal computer, and so forth. Furthermore, the image forming apparatus includes a control unit 52 that controls operation of each device in the image forming apparatus. The control unit 52 includes a Central Processing Unit (CPU), a Random Access Memory (RAM), a Read Only Memory (ROM), and so forth.

In the image forming apparatus described above, the process unit 2Y for yellow is the process unit that is located substantially at the upstream end among other process units 2M, 2C, and 2K in the transfer process. Thus, the toner already transferred onto the intermediate transfer belt 61 at the upstream from the process units 2M, 2C, and 2K may be reversely transferred to the photoreceptors in the process units 2M, 2C, and 2K.

In view of the above, the present inventor performed experiments using a test machine having a configuration similar to the image forming apparatus of the illustrative embodiment. In the test machine, when the test machine received multiple image information corresponding to a plurality of recording media sheets in the continuous output mode, reverse transfer occurred easily.

Similar to the configuration illustrated in FIG. 2, the test machine included a casing for the drum cleaning device 18Y (hereinafter referred to as a cleaning casing) disposed opposite the intermediate transfer belt 61 with a slight gap therebetween. A part of toner on the intermediate transfer belt 61 transferred to the surface of the cleaning casing opposite the intermediate transfer belt 61. The toner accumulated on the cleaning casing over time.

Furthermore, in the test machine, though the cause was unknown, the potential of the intermediate transfer belt 61 increased little by little during the continuous output mode in which approximately 500 recording media sheets were output in an extended time period. When the potential of the intermediate transfer belt 61 increased to a certain potential, electric discharge occurred between the portion of the cleaning casing facing the intermediate transfer belt 61 at which the toner adhered and the intermediate transfer belt 61. Adhesion of the toner and the intermediate transfer belt significantly dropped in the place where the electrical discharge occurred.

As a result, the toner of yellow, adhesion of which had dropped, was transferred from the intermediate transfer belt 61 back to the photoreceptors 3M, 3C, and 3K in the process units 2M, 2C, and 2K disposed downstream in the transfer process.

In the second process unit 2M and the third process unit 2C, electrical discharge occurred between the portion of the cleaning casing at which the toner adhered and the intermediate transfer belt 61 so that the adhesion between the toner and the intermediate transfer belt 61 undesirably deteriorated. Similarly, the reverse transfer of toner occurred in the process unit disposed downstream from the process units 2M and 2C in the transfer process.

In the experiments, the potential of the intermediate transfer belt 61 in the continuous output mode continued rising until application of the transfer bias to the intermediate transfer belt was halted. Even though the potential of the intermediate transfer belt increased to some degree, when application of the transfer bias to the intermediate transfer belt was temporarily halted for a certain period of time, the potential of the transfer belt returned to a normal value after application of the transfer bias was resumed.

Figure 4:
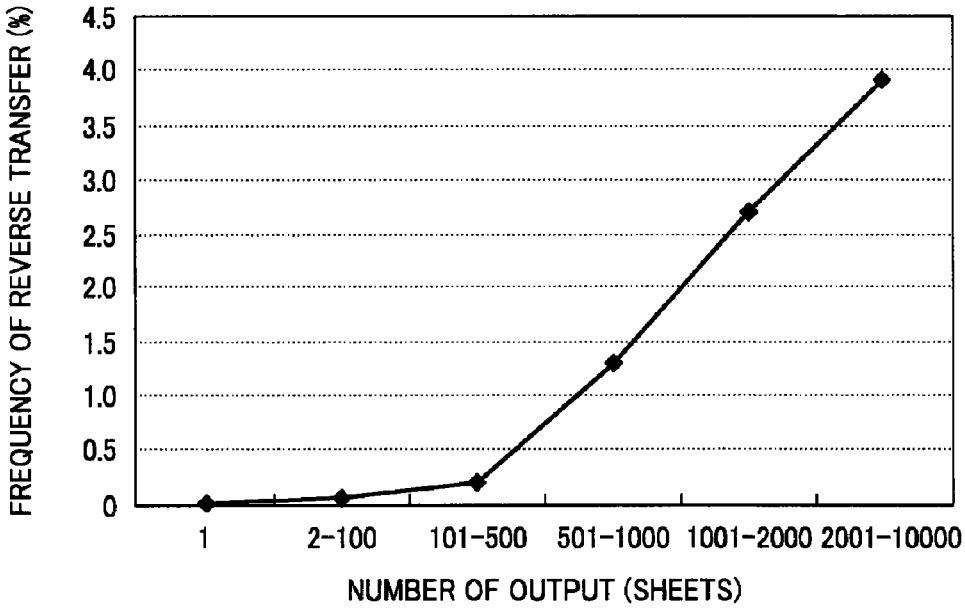
FIG. 4 is a graph showing a relation between frequency of reverse transfer and the number of sheets continuously output.

Referring now to FIG. 4, there is provided a graph showing a relation between frequency of the reverse transfer and the number of sheets that were continuously output during the experiments using the test machine. The frequency of the reverse transfer herein refers to a ratio of the number of sheets that the reverse transfer occurred relative to the total number of sheets continuously output in the continuous output mode. The number of sheets output corresponds to the number of images output.

In FIG. 4, the vertical axis refers to the frequency of the reverse transfer. The horizontal axis refers to the number of sheets continuously output. As shown in FIG. 4, during the continuous output mode, as the number of sheets continuously output increased, the reverse transfer occurred more easily. This is because the increase in the potential of the intermediate transfer belt 61 tends to occur more easily as the number of sheets continuously output increases. In the test machine, when the total number of sheets continuously output reached 500 sheets, the frequency of the reverse transfer started to increase rapidly.

Figure 5:
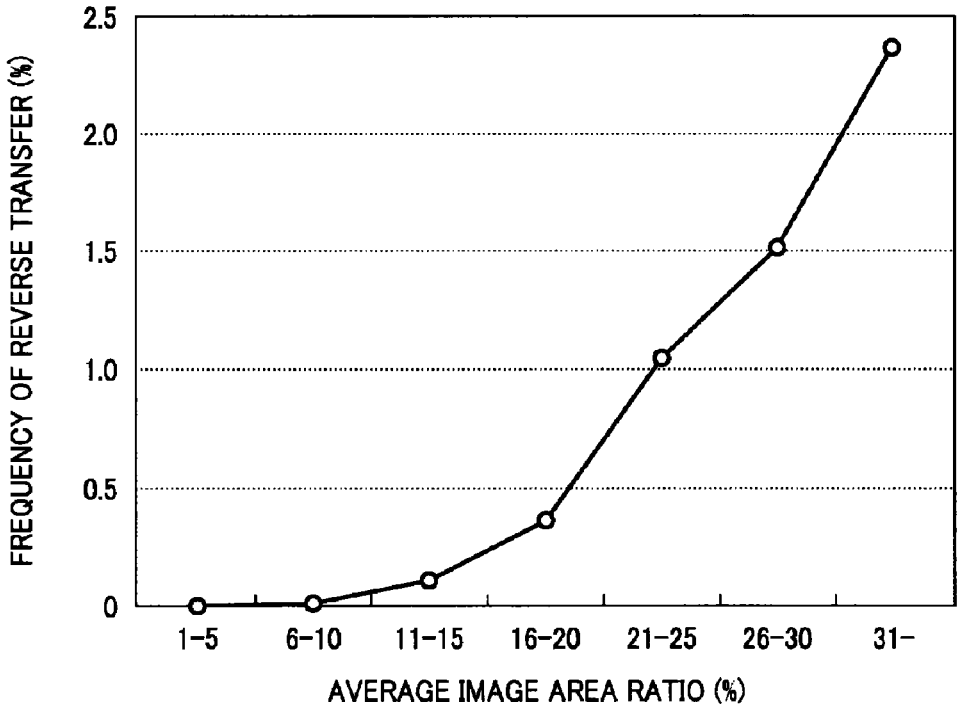
FIG. 5 is a graph showing a relation between a frequency of the reverse transfer and an average image area ratio.

With reference to FIG. 5, a description is provided of a relation between the frequency of the reverse transfer and an average image area ratio based on the experiments using the test machine. The average image area ratio herein refers to an accumulated image area ratio of each print divided by the total number of sheets continuously output. The image area ratio refers to a ratio of an image area to the total area of a sheet (one page). The image area can be obtained based on the number of dots written in the optical writing process during the image forming operation.

As shown in FIG. 5, during the continuous output mode, as the average image area ratio increased, the reverse transfer occurred more easily. In the test machine, as shown in FIG. 5, when the average image area ratio was equal to or greater than 15%, the reverse transfer ratio increased rapidly.

Furthermore, in the experiments using the test machine, a rapid increase in the reverse transfer ratio was observed when the temperature and the humidity started to fall below a predetermined threshold value. In particular, when the temperature was equal to or less than 19 deg. C and the humidity was equal to or less than 30%, the reverse transfer ratio started to rise rapidly.

Figure 6:
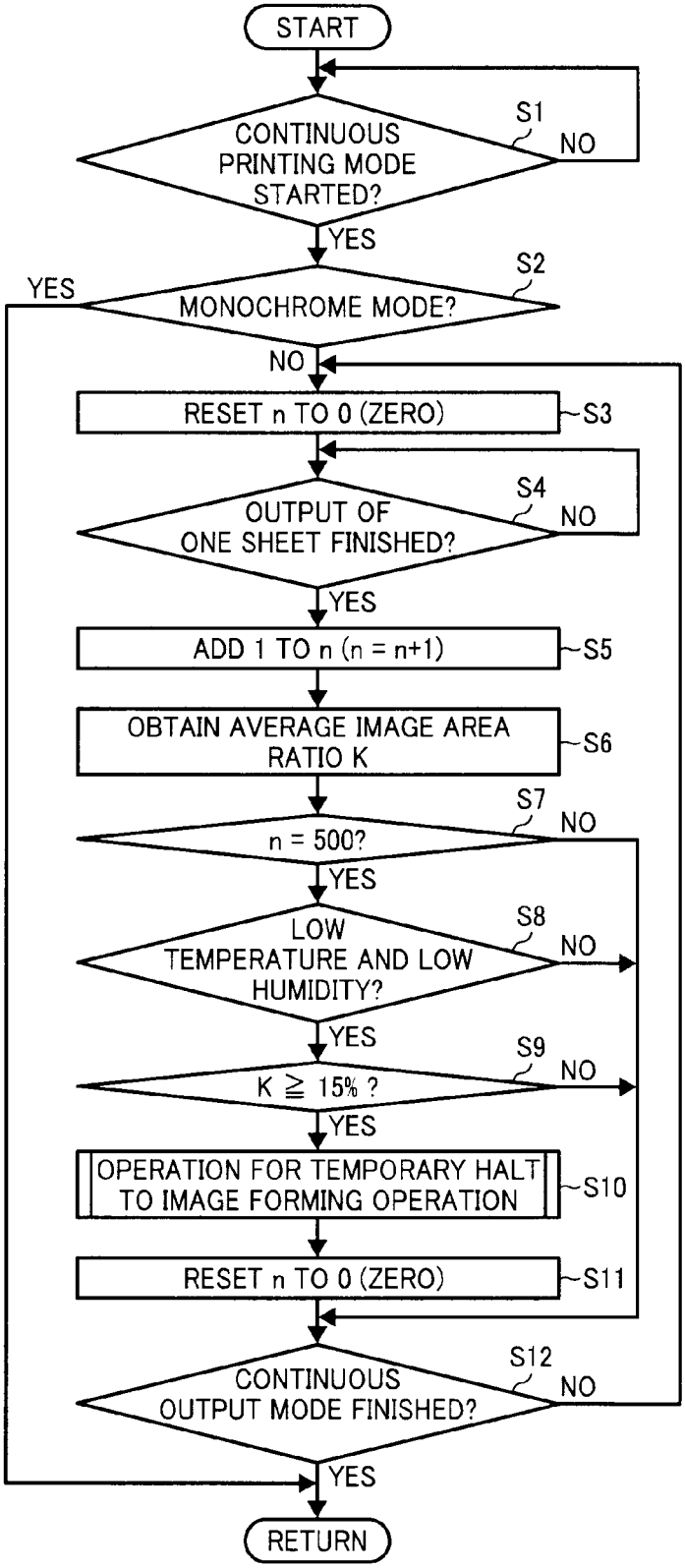
FIG. 6 is a flowchart showing an exemplary procedure of a control of a continuous printing operation.

Next, with reference to FIG. 6, a description is provided of a control of the continuous printing operation. FIG. 6 is a flowchart showing an exemplary procedure of the control. In this procedure, the continuous printing operation is temporarily halted as needed.

As shown in FIG. 6, when the continuous output mode is started at step S1 (YES, S1), whether or not the printing mode is a monochrome mode in which a monochrome image is formed is determined at step S2. In the monochrome mode, the toner images of yellow, magenta, and cyan are not formed. Thus, even when the number of sheets continuously output increases, reverse transfer does not occur. If the printing mode is the monochrome mode (YES, S2), the image forming operation is not temporarily halted and the flow returns to step S1.

By contrast, if the printing mode is not the monochrome mode (NO, S2), reverse transfer may occur during the continuous output mode. Thus, at step S3, n is reset to 0 (zero) where n is the number of sheets continuously output (n=0). The subsequent sheet is not output until output of one sheet is completed at step S4 (NO, S4).

After the sheet is output at step S4 (YES, S4), 1 is added to the number n of sheets continuously output at S5 (n=n+1). Subsequently, the average image area ratio K is obtained at step S6. Subsequently, whether or not the image forming operation needs to be temporarily halted is determined.

According to the illustrative embodiment, when the number n of sheets continuously output reaches 500 sheets, the temperature and the humidity are low, and the average image area ratio K is 15% (YES at S7, YES at S8, and YES at S9), the image forming operation is temporarily halted at step S10. At step S10, application of the primary transfer bias by the transfer bias application mechanism, in particular, the primary transfer power source, is also halted. Subsequently, the number n of the sheets continuously output is reset to 0 (zero) at step S11 (n=0). When the continuous output mode is not finished at step S12 (NO, S12), the flow returns to step S3 and steps S3 through S9 are performed.

Alternatively, the image forming operation can be temporarily halted at step S10 in accordance with at least one of the number n of sheets continuously output, the average image area ratio of images continuously output, temperature, and humidity.

By contrast, if the number n of sheets continuously output does not count 500 sheets or the temperature and the humidity are not low or the average image area ratio K is not 15% (NO at S7 or NO at S8 or NO at S9), and the continuous output mode is not finished at S12 (NO, S12), the flow returns to step S3. Then, steps S3 through S9 are performed.

According to the illustrative embodiment, the threshold value of the temperature that is considered as "low" is, for example, 9 deg. C or less. The threshold value of the humidity that is considered as "low" is, for example, 30% or less.

Although the image forming operation is temporarily halted, power is kept supplied to the heater of the heating roller 45 of the fixing unit 43, thereby heating the fixing belt constantly.

It is to be noted that the image forming operation includes at least operation of the process unit and the intermediate transfer belt 61.

According to the present embodiment, application of the primary transfer bias by the transfer bias application mechanism including the primary power source is temporarily halted in the continuous output mode as necessary. Even when the potential of the intermediate transfer belt 61 rises to a certain degree, the potential can be reset to an original value by temporarily stopping application of the primary transfer bias, thereby reducing, if not preventing entirely, the reverse transfer of the toner in the continuous output mode.

When application of the primary transfer bias is temporarily halted, the secondary transfer bias is also temporarily halted at the same time. This is because the secondary transfer bias may also cause the rise in the belt potential.

It is to be noted that it is not necessary to temporarily stop the image forming operation when application of the primary transfer bias is temporarily halted. For example, the process units and the intermediate transfer belt 61 may remain in operation while application of the primary transfer bias is temporarily halted.

However, in the image forming apparatus according to the illustrative embodiment, when application of the primary transfer bias is temporarily halted, the image forming operation is also temporarily halted. The advantage of this configuration is that wasteful consumption of energy is reduced, if not prevented entirely. Operation of the process units and the intermediate transfer belt 61 during temporary halt to application of the primary transfer bias causes wasteful consumption of energy.

According to the illustrative embodiment, power is continuously supplied to the heater in the fixing unit 43 while the image forming operation is temporarily halted in the continuous output mode. The advantage of this configuration is that since the temperature of the fixing belt 46 in the fixing unit 43 is heated high enough to fix the toner image at the time of completion of temporary halt to the image forming operation, it is possible to resume the image forming operation promptly.

According to the illustrative embodiment, the timing of temporary halt to the application of the primary transfer bias is determined based on the number n of sheets continuously output in the continuous output mode, the average image area ratio K of images continuously output, and the temperature and the humidity.

Based on the number n of sheets continuously output in the continuous output mode, the average image area ratio K of images continuously output, and the temperature and the humidity, the timing in which the reverse transfer of the toner occurs notably is predicted with precision, and the application of the primary transfer bias can be halted properly.

It is to be noted that the temperature and the humidity are detected by a generally-known temperature and humidity sensor.

According to the illustrative embodiment, when the number n of sheets continuously output reaches a threshold value, that is, 500 sheets, the application of the primary bias is temporary halted. In particular, as illustrated in FIG. 4, the application of the primary bias is temporarily halted when the reverse transfer ratio starts to increase rapidly.

Furthermore, according to the illustrative embodiment, when the average image area ratio K is equal or greater than 15%, application of the primary transfer bias is temporarily halted. In particular, as illustrated in FIG. 5, the application of the primary bias is temporarily halted when the reverse transfer ratio starts to increase rapidly.

According to the illustrative embodiment, when the temperature and the humidity are equal to or less than the certain threshold value, application of the primary transfer bias is temporarily halted. As described above, application is temporary halted when the reverse transfer ratio starts to increase rapidly.

Still further, according to the illustrative embodiment, when a monochrome image is formed using one of the photoreceptors during the continuous output mode, application of the primary transfer bias is not halted. Since the monochrome mode does not cause the reverse transfer, it is not necessary to halt application of the transfer bias, thereby preventing unnecessary standby in the operation.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

a receiver to receive image information from an external device;

a movable intermediate transfer member;

a plurality of latent image bearing members disposed substantially in proximity to the intermediate transfer member and arranged along a direction of movement of the intermediate transfer member, a latent image formed on each of the latent image bearing members based on the image information;

a plurality of developing devices, disposed in proximity to the latent image bearing member, to develop the latent image on the latent image bearing member with toner to form a toner image thereon;

a transfer bias application mechanism to apply a transfer bias to the intermediate transfer member and transfer the toner images onto the intermediate transfer member on one another; and a secondary transfer member to transfer the superimposed toner image onto a recording medium, the transfer bias application mechanism halting temporarily and periodically application of the transfer bias in a continuous output mode in which a plurality of images are continuously formed on different recording media sheets based on the image information of the plurality of images received continuously by the receiver, wherein when only one of the plurality of the latent image bearing members is used to form an image in the continuous output mode, application of the transfer bias is not halted.

2. The image forming apparatus according to claim 1, wherein when application of the transfer bias is temporarily halted, image forming operation is also temporarily halted.

3. The image forming apparatus according to claim 2, further comprising a fixing device including a heat source, to heat the recording medium bearing the toner image and fix the toner image onto the recording medium, wherein power is kept supplied to the heat source of the fixing device even when the image forming operation is temporarily halted.

4. The image forming apparatus according to claim 1, wherein a timing with which application of the transfer bias is temporarily halted is determined based on at least one of a number of continuously output images output in the continuous output mode, an average image area ratio of images continuously output, temperature, and humidity.

5. The image forming apparatus according to claim 4, wherein application of the transfer bias is temporarily halted when the number of continuously output images reaches a predetermined threshold value.

6. An image forming apparatus, comprising:

a receiver to receive image information from an external device;

a movable intermediate transfer member;

a plurality of latent image bearing members disposed substantially in proximity to the intermediate transfer member and arranged along a direction of movement of the intermediate transfer member, a latent image formed on each of the latent image bearing members based on the image information;

a plurality of developing devices, disposed in proximity to the latent image bearing member, to develop the latent image on the latent image bearing member with toner to form a toner image thereon;

a transfer bias application mechanism to apply a transfer bias to the intermediate transfer member and transfer the toner images onto the intermediate transfer member on one another; and a secondary transfer member to transfer the superimposed toner image onto a recording medium, the transfer bias application mechanism halting temporarily and periodically application of the transfer bias in a continuous output mode in which a plurality of images are continuously formed on different recording media sheets based on the image information of the plurality of images received continuously by the receiver, wherein a timing with which application of the transfer bias is temporarily halted is determined based on at least one of a number of continuously output images output in the continuous output mode, an average image area ratio of images continuously output, temperature, and humidity, wherein application of the transfer bias is temporarily halted when the number of continuously output images reaches a first predetermined threshold value, wherein application of the transfer bias is temporarily halted when the average image area ratio is equal to or greater than a second predetermined threshold value.

7. The image forming apparatus according to claim 6, wherein the second predetermined threshold value is 15%.

8. The image forming apparatus according to claim 4, wherein application of the transfer bias is temporarily halted when at least one of the temperature and the humidity is equal to or less than a predetermined threshold value.

9. The image forming apparatus according to claim 8, wherein the predetermined threshold value is 19° C. and 30% relative humidity, respectively.

10. A method for continuously forming images on a plurality of recording media sheets, comprising:

receiving image information from an external device;

forming a latent image on each of a plurality of latent image bearing members based on the image information;

developing the latent image on each of the plurality of the latent image bearing members with toner to form toner images thereon;

applying a transfer bias to an intermediate transfer member to transfer the toner images onto the intermediate transfer member on one another;

transferring the superimposed toner image onto a recording medium; and halting temporarily and periodically application of the transfer bias in a continuous output mode in which a plurality of images are continuously formed on different recording media sheets based on the image information of the plurality of images received continuously by the receiving step, wherein the halting is not carried out when only one of the plurality of the latent image bearing members is used to form an image in the continuous output mode.

11. The method according to claim 10, further comprising halting image forming operation when application of the transfer bias is temporarily halted.

12. The method according to claim 10, further comprising:

fixing the toner image onto the recording medium, the fixing including heating the recording medium that bears the toner image thereon; and supplying power to the heating even when the image forming operation is temporarily halted.

13. The method according to claim 10, wherein a timing of the halting is determined based on at least one of a number of continuous output of images in the continuous output mode, an average image area ratio of images continuously output, temperature, and humidity.

14. The method according to claim 13, wherein the halting is carried out when the number of continuous output of images reaches a predetermined threshold value.

15. A method for continuously forming images on a plurality of recording media sheets, comprising:

receiving image information from an external device;

forming a latent image on each of a plurality of latent image bearing members based on the image information;

developing the latent image on each of the plurality of the latent image bearing members with toner to form toner images thereon;

applying a transfer bias to an intermediate transfer member to transfer the toner images onto the intermediate transfer member on one another;

transferring the superimposed toner image onto a recording medium; and halting temporarily and periodically application of the transfer bias in a continuous output mode in which a plurality of images are continuously formed on different recording media sheets based on the image information of the plurality of images received continuously by the receiving step, wherein a timing of the halting is determined based on at least one of a number of continuous output of images in the continuous output mode, an average image area ratio of images continuously output, temperature, and humidity, wherein the halting is carried out when the number of continuous output of images counts a first predetermined threshold value, wherein the halting is carried out when the average image area ratio is equal to or greater than a second predetermined threshold value.

16. The method according to claim 15, wherein the second predetermined threshold value is 15%.

17. The method according to claim 13, wherein the halting is carried out when at least one of the temperature and the humidity is equal to or less than a predetermined threshold value.

18. The method according to claim 17, wherein the predetermined threshold value is 19° C. and 30% relative humidity, respectively.

19. An image forming apparatus, comprising:

a receiver to receive image information from an external device;

a movable intermediate transfer member;

a plurality of latent image bearing members disposed substantially in proximity to the intermediate transfer member and arranged along a direction of movement of the intermediate transfer member, a latent image formed on each of the latent image bearing members based on the image information;

a plurality of developing devices, disposed in proximity to the latent image bearing member, to develop the latent image on the latent image bearing member with toner to form a toner image thereon;

a primary transfer bias application mechanism to apply a primary transfer bias to the intermediate transfer member and transfer the toner images onto the intermediate transfer member on one another; and a secondary transfer bias application mechanism to apply a secondary transfer bias to transfer the toner images from the intermediate transfer member onto a recording medium, the primary transfer bias application mechanism and secondary transfer bias application mechanism each halting temporarily and periodically application of the respective primary and secondary transfer bias in a continuous output mode in which a plurality of images are continuously formed on different recording media sheets based on the image information of the plurality of images received continuously by the receiver, wherein the primary transfer bias application mechanism and the secondary transfer bias application mechanism temporarily and periodically halt the application of the respective primary and secondary transfer bias after determining the completion of the continuous formation of images on a predetermined number of sheets sufficient that the potential on the intermediate transfer member may cause reverse transfer, and the primary transfer bias application mechanism and the secondary transfer bias application mechanism maintain the halting of the application of the respective primary and secondary transfer bias for a sufficient time that the potential on the intermediate transfer member is reduced such that reverse transfer will not occur.

20. A method for continuously forming images on a plurality of recording media sheets, comprising:

receiving image information from an external device;

forming a latent image on each of a plurality of latent image bearing members based on the image information;

developing the latent image on each of the plurality of the latent image bearing members with toner to form toner images thereon;

applying a primary transfer bias to an intermediate transfer member to transfer the toner images onto the intermediate transfer member on one another;

applying a secondary transfer bias to transfer the toner images from the intermediate transfer member onto a recording medium; and halting temporarily and periodically application of the primary and secondary transfer bias in a continuous output mode in which a plurality of images are continuously formed on different recording media sheets based on the image information of the plurality of images received continuously by the receiving step, wherein the temporary and periodic halting of the application of the respective primary and secondary transfer bias is done after determining the completion of the continuous formation of images on a predetermined number of sheets sufficient that the potential on the intermediate transfer member may cause reverse transfer, and the temporary and periodic halting of the application of the respective primary and secondary transfer bias is maintained for a sufficient time that the potential on the intermediate transfer member is reduced such that reverse transfer will not occur.

* * * * *